US006174431B1

(12) United States Patent
Williams et al.

(10) Patent No.: US 6,174,431 B1
(45) Date of Patent: Jan. 16, 2001

(54) METHOD FOR OBTAINING BASE OIL AND REMOVING IMPURITIES AND ADDITIVES FROM USED OIL PRODUCTS

(75) Inventors: Michael R. Williams, Highland; Jan Krzykawski, Provo, both of UT (US)

(73) Assignee: Interline Hydrocarbon, Inc., Alpine, UT (US)

( * ) Notice: Under 35 U.S.C. 154(b), the term of this patent shall be extended for 0 days.

(21) Appl. No.: 09/318,711

(22) Filed: May 26, 1999

Related U.S. Application Data

(63) Continuation-in-part of application No. 09/086,139, filed on May 28, 1998.

(51) Int. Cl.[7] ..... C10M 175/00

(52) U.S. Cl. ..... 208/183; 208/45; 208/180; 208/181; 208/182

(58) Field of Search ..... 208/183, 179, 208/180, 181, 182; 210/727

(56) References Cited

U.S. PATENT DOCUMENTS 3,773,658 * 11/1973 Vu et al. ..... 208/180
4,431,524 * 2/1984 Norman ..... 208/183
4,522,729 * 6/1985 Tabler ..... 210/727
6,007,701 * 12/1999 Sherman et al. ..... 208/181

* cited by examiner

*Primary Examiner*—Bekir L. Yildirim
(74) *Attorney, Agent, or Firm*—Daniel McCarthy

(57) ABSTRACT

A method for pretreating and re-refining used oil that requires only moderate heat and only one re-refining step. The pretreatment involves mixing the used oil with a basic solution and optionally a phase transfer catalyst. The phase transfer catalyst aids the chemical reaction which allows removal of impurities in used oil. The basic solution preferably includes more than one base. The used oil, basic solution and phase transfer catalyst are mixed under low heat. The pretreated oil is then mixed with liquid propane in a non-turbulent manner, such as by use of a globe valve or orbit valve. The mixture of used oil and liquid propane are then placed into an extraction vessel and impurities are allowed to settle out of the oil and propane mixture. Heavy fraction may be removed from the extraction vessel. Preferably, a second vessel called a settling vessel will be used to cause further settling of impurities out of the used oil. Light fraction is produced which may be re-refined to produce base oil. The heavy fraction may be used for asphalt production. The invented method and system removes interfering amounts of metals, additives and additive derivative products from used oil and produces useful base oil.

20 Claims, 1 Drawing Sheet

Figure 1:
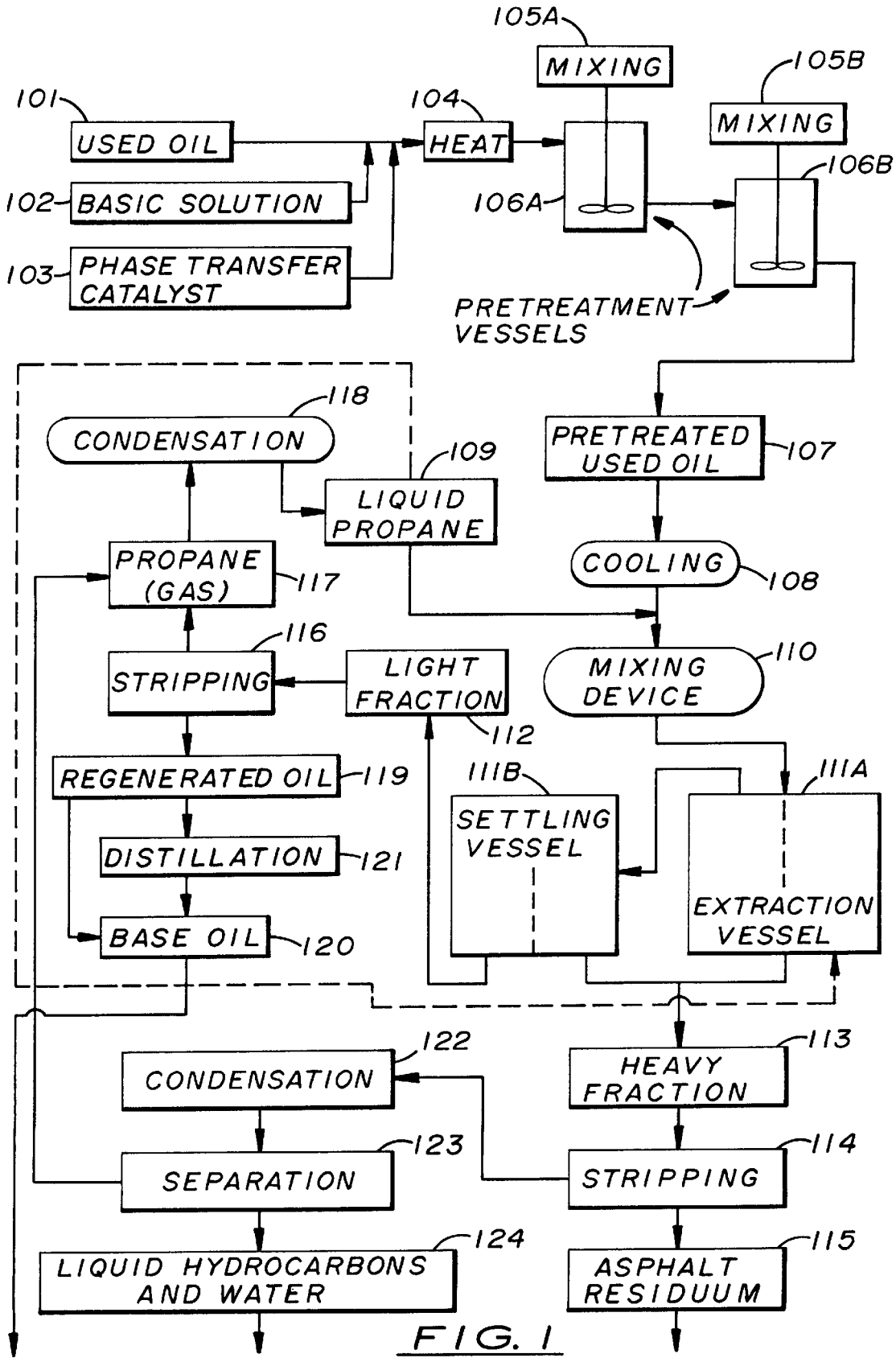

METHOD FOR OBTAINING BASE OIL AND REMOVING IMPURITIES AND ADDITIVES FROM USED OIL PRODUCTS

PRIORITY

This patent application is a continuation-in-part of U.S. patent application Ser. No. 09/086,139 filed on May 28, 1998, and priority is claimed thereto.

I. BACKGROUND OF THE INVENTION

A. Field of the Invention

The present invention relates generally to the recovery and regeneration of used lubricant and industrial oils. More specifically, the present invention relates to the treatment and refinement of used lubricants and industrial oils to produce re-refined base oil and to remove additives and impurities from used oils and lubricants.

B. Description of Related Art

Commercial, residential and industrial machinery generate large amounts of used oils. In particular, the maintenance of mechanical devices with active components generates a considerable amount of used oil. In this context, used oil refers to used lubricants and industrial oils, whether they are used for lubricating, hydraulic, or other purposes, in mechanical, electrical electrical or other types of equipment. Used oil also includes synthetic oils and mineral oils that are obtained from natural sources.

Used oil does not retain the characteristics that made the original base oil suitable for its intended purpose, and it must be disposed of or re-refined. Burning used oil is one way of disposing of it. Although this causes significant pollution and releases many hazardous metals into the air, burning of used oil is accepted as a used oil disposal method. Whereas burning used oil dramatically reduces the amount of solid and liquid material that must eventually be disposed of, the volatile products that are emitted during incineration are found to be unacceptable under some environmental risk assessment and management schemes. In addition, incineration of used oil leads to calcination products and dissipated thermal energy. Incineration products may give rise to environmental pollutants, depending on the substances that are present in the incinerated products. Thermal energy that is dissipated in the environment may be an unacceptable source of thermal pollution. Finally, incineration of used oil products may also cause environmental pollution through the emission of gases and particulate matter that increase air pollution or contribute to detrimental greenhouse effects. Due to the problems associated with the burning of used oil, reprocessing (or re-refining) is an alternative that should be considered on environmental and economic grounds. In addition, some countries have banned the burning of used oil.

Used oil can be reprocessed into useful base oil. To be economically efficient, the oil must be regenerated by a process that preserves the useful characteristics of the oil, but removes additives and impurities. This recovery and regeneration goal faces the challenge imposed by the complex chemical composition of used oil. For most applications, oil is a mixture of a base oil and a number of additives; the additives enhance the useful characteristics of oil. For example, engine oil typically contains rust inhibitors, antioxidants, antiwear agents, detergent-dispersants, antifoaming agents and viscosity index improvers. When oil is used, however, the constituents of the base oil and the additives break down through a series of chemical and thermal reactions. These reactions create a complex mixture of chemical species.

For example, in addition to degraded and broken down additives, used engine oil contains metals and metal compounds that include lead, iron, calcium, zinc, sodium and magnesium, and phosphorous, sulfur and nitrogen containing compounds. This complexity is the main challenge faced by any used oil re-re-refining method. For example, some of the chemical species present in used oil directly interfere with re-refining operations. Other chemical species react during re-refining and form products that interfere with subsequent re-refining steps. Finally, some chemical species are not removed by the re-refining process and interfere with intended uses of the re-refined base oil. As used herein, re-refining and its related terms refer to the series of recovery and regeneration operations that transform used oil into a useful base oil by removing additives, asphaltic material, and other impurities. A base oil is a re-refined oil that can be used in industrial applications in general and as a lubricant in particular. Base oil that is substantially free of impurities can also be used as a feed stock to petroleum refinery process units including the fluid catalytic cracking unit. Additives can be incorporated into the re-refined base oil when the specific application so requires. Asphaltic material and impurities consist of a heavy fraction, or high molar mass fraction, and breakdown products of the oil and its additives. The asphaltic material and other impurities can form a residuum (often simply called resid) which is useful as a asphalt extender.

The impurities that must be removed from used oil during re-refining include acids, water, suspended solids, light hydrocarbons, glycols, sulfur compounds, metals and organometallic compounds, and mixtures of a variety of polymers. In particular, the removal of organometallic compounds and polymers from used oil is difficult because they are hydrophillic, and most of them vaporize at a temperature that is very similar to that at which the base oil vaporizes. In addition, used oil has a high viscosity which is detrimental to the distillation step in the re-refining process.

Polymers and metals, including zinc, calcium, and phosphorous compounds, are among the impurities that must be eliminated during re-refining to obtain a good quality base oil and to avoid fouling of re-refining equipment. In particular, the elimination or reduction of zinc compounds in used oil to a non-interfering level is very important for avoiding downstream re-refining equipment fouling. Zinc is an active species in polymerization reactions and it is present as a zinc dialkyldithiophosphate (ZdP), among other forms. ZdPs and related compounds are added to oils because they act as antioxidant agents. They also reduce the oil's wear as a lubricant, and they protect metals against corrosion. Nevertheless, ZdPs undergo hydrolysis and thermal decomposition. ZdP decomposition has been studied by, for example, J. J. Dickert and C. N. Rowe, *Journal of Organic Chemistry,* Vol. U32 (1967), pp. 647 et seq. This reference is incorporated by reference herein. ZdP is a source of acidic compounds, and it eventually forms insoluble zinc phosphate that causes fouling of re-refining equipment. Thermal decomposition of ZdP usually produces a glassy insoluble polymeric solid that is one of the major causes of re-refining equipment fouling. This fouling includes the plating out of the polymers in heat exchangers and distillation columns.

One method of processing and re-refining used oil uses propane as a solvent to extract oil. For example, U.S. Pat. No. 2,070,626 describes a process for mixing used oil with liquid propane to remove asphaltic materials and other oxidation products. This patent is incorporated by reference herein. Similarly, U.S. Pat. No. 2,196,989 describes a process for separating asphaltic compounds from crude oil to produce a lubricating oil. This patent is incorporated by reference herein. In this process, the oil is mixed with a light hydrocarbon solvent such as liquid propane or butane. A substantially inert gas precipitates impurities from the oil-propane mixture. U.S. Pat. No. 3,870,625 describes another process for de-asphalting residues from the vacuum distillation of petroleum or from used mineral oils. This patent is incorporated by reference herein. The oil or distillation residue is injected under pressure into liquid propane in a pulsed manner to facilitate dispersion of the oil material in the solvent as fine droplets. Improvements to this process are disclosed in U.S. Pat. No. 4,265,734, which is also incorporated by reference herein. Finally, U.S. Pat. Nos. 5,286,380 and 5,556,548 disclose an apparatus and method for removing contaminants from used motor oil by means of extraction with a liquid hydrocarbon and a gas. These patents are incorporated by reference herein.

A major disadvantage of these prior methods is that they do not remove certain contaminants from used oil. For example, because ZdP and certain zinc-based impurities are soluble in organic phases, extraction with propane does not efficiently separate them from the oil. Furthermore, the presence of metal and polymeric compounds causes fouling of the re-refining equipment when they are present in the used oil.

U.S. Pat. No. 4,376,040 discloses a process for treating and regenerating used oil products that relies on the agitation of used oil and a quaternary ammonium salt or mixture of salts. This patent is incorporated by reference herein. The claimed process relies on the use of a quaternary ammonium salt that contains at least one aryl ring, or a mixture of such salts. Reportedly, this process does not remove or deteriorate oil additives.

A pretreatment process that uses a basic compound of an alkali metal for avoiding acidification and fouling in the re-refining of waste lubricating oil is disclosed in Canadian Patent No. 2,068,905. This patent is incorporated by reference herein. This pretreatment process does not utilize a phase transfer catalyst for assisting in the chemical reactions that cause the break down of impurities into compounds that will separate in a subsequent liquid-to-liquid extraction.

PCT publication no. WO 98/26031 (based on PCT patent application no. PCT/FR/02224) discloses a process for re-refining waste oil. That publication is hereby incorporated by reference.

Another method for reprocessing used engine oil is a vacuum distillation process followed by hydrotreating. In this process, waste oil is heated to about 150° C. to remove any water as well as light hydrocarbons. The dewatered oil, containing additives, is then heated to about 260° C. to remove any diesel fraction. The oil with its additives is then heated to about 370° C. in a distillation column operating at about 5 mm Hg absolute to separate the base oil from the additives and the base oil distillate is then hydrotreated to improve color and odor. Hydrotreating also removes a portion of residual polycyclic aromatic compounds. The main problem with this process is that the additives and their breakdown products are not removed until the distillation step. By then the oil, additives, and additive derivatives have been heated to over 370° C., at which temperature thermal cracking of the polymeric compounds and thermal decomposition of the organo-metallic compounds produce severe coking and corrosion in the distillation column and ancillary plant. Coking and corrosion of the plant not only interferes with throughput efficiencies but also results in poor quality lube oil distillate.

Generally speaking, thin film evaporators of the type employed in the process described above are expensive to construct and operate on a per unit throughput capacity. In addition, about 2% of the light oil (diesel) fraction is lost in this process in the water removal stage and about 3% of the available base oil is lost in the final distillation stage due to retention in the asphaltic component.

Several lubricating oil compositions that incorporate quaternary ammonium salts are known. These include the compositions disclosed in U.S. Pat. Nos. 4,388,200, 4,273,663, 4,253,980, 4,251,380, 3,962,104, and 5,126,397. A quaternary ammonium salt has been employed in a process for removing catalyst residues from olefin polymerization products, as disclosed in U.S. Pat. No. 5,196,630. Each of the aforementioned patents and references is hereby incorporated by reference in its entirety for the material disclosed therein.

U.S. Pat. Nos. 4,624,763, 4,624,764, 4,661,226, 4,634,510, 4,627,901, 4,622,119, and 4,622,118 describe the removal of waxes from lubricating oil by the induction of a high voltage charge into oil-solvent mixtures to obtain nucleation of wax particles before precipitation. These patents are incorporated by reference in their entirety for the material disclosed therein.

Australian Patent Number 605,288 and U.S. Pat. No. 5,066,386 describe processes for extraction of oil from stable oil-water emulsions. This patent is incorporated by reference herein. In this process, a liquefied hydrocarbon solvent is added to the emulsion forming an oil solvent phase. The pressure is then reduced to allow the pressurized liquid solvent to vaporize, whereupon the emulsion breaks into oil and water phases.

In addition to removing metals, organometallic compounds and polymers from oil, re-refining methods also need to efficiently remove oil additives and the breakdown products of the additives. For many uses of re-refined base oil, the presence of additives and breakdown products in the re-refined oil is unacceptable. For example, viscosity index improvers are added to oil to widen the temperature range within which the oil retains a certain viscosity. These additives are usually polymers at a concentration that can be as high as 12% by weight. Viscosity index improvers, however, can undergo a variety of thermal and oxidative reactions while the oil is used and in re-refining operations. Thermal processes may lead to depolymerization and pyrolysis of ester chains to form olefins and acids. Oxygen and in general any source of free radicals may oxidize viscosity index improvers. Once a polymer radical is formed, polymer backbone cleavage is possible. In essence, most of these additives are significantly degraded at temperatures of 260° C. or above. Thermal or oxidative degradation, or a combination of both, will lead to used oil with a complex mixture of additives and additive degradation products. Treatments that do not significantly alter the additive composition of a used oil may not produce a base oil that is free from additives or degradation products. Testing has shown that extraction with propane alone does not completely remove viscosity index improvers from used oil. Furthermore, subsequent re-refining during oil re-refining subjects oil to temperatures above 260° C., which causes remaining viscosity index improvers to decompose during distillation. These decomposition products will cause fouling of the re-refining equipment. Thus, there is also a need for an oil re-refining method which efficiently extracts additives and breakdown products in general, and viscosity index improvers in particular, from used oil.

It is notable that the most successful prior art methods for recovering base oil from waste oil include placing a caustic in the waste oil and heating the waste oil to a very high temperature, such as 650 degrees Fahrenheit, thereby causing hydrocarbon cracking and distillation in order to purify the waste oil. As will be seen below, the invented method does not involve the use of high levels of heat or the use of hydrocarbon cracking in the pretreatment process where most contaminants are removed from the waste oil.

The limited scope of current used oil re-refining methods leads to fouling problems when a variety of used oils are treated and re-refined. Among the many prior art methods, there still remains a need for a process for pretreating and a process for re-refining used oil in order to remove impurities and generate a substantially clean base oil on an economically efficient basis. The invention satisfies this need.

III. SUMMARY OF THE INVENTION

It is desirable to recycle used oil from a variety of sources to obtain a base oil that can be used alone or with additives in commercial, residential and industrial applications in general and as lubricant or cat cracker feed in particular. Specifically, it is desirable to recycle used oil by a process that chemically alters the zinc-based additives and degradation products, as well as other metal and phosphorous compounds and polymers, so that they are efficiently removed from the used oil. It is also desirable to remove these impurities by precipitation along with other residues and water. These operations, and especially the precipitation of impurities, together with any needed re-re-refining, should be performed economically and with minimal fouling of the re-refining equipment. Precipitate and its related terms are hereinafter used to refer to any operation that involves the separation of a substance by any of the following processes: clarification, sedimentation, flocculation, coagulation, precipitation, settlement or a combination thereof.

A general objective of some embodiments of the invention is to provide a method for re-refining used oil that includes a pretreatment and a subsequent liquid-to-liquid extraction with a lower liquid alkane, such as propane.

It is a further objective of some embodiments of this invention to provide a method for batch or continuous re-refining of used oil. It is in particular a further objective of some embodiments of this invention to provide a used oil re-refining method for removing impurities by liquid-to-liquid mass transfer and precipitation (also referred to as liquid-to-liquid extraction).

It is a further objective of some embodiments of this invention to provide a re-refining method for re-refining used oil into a base oil with a lower viscosity and metal content oil.

It is a further objective of some embodiments of this invention to provide a re-refining method for producing an asphalt residuum from used oil. In particular, it is a further object of some embodiments of this invention to provide an asphalt residuum which can be used as an asphalt extender.

It is a further objective of some embodiments of this invention to provide a used oil re-refining method that does not rely on an acidic treatment of the used oil.

It is a further objective of some embodiments of this invention to provide a used oil re-refining method that does not require water removal from the used oil prior to treatment. In particular, it is a further object of this invention to provide a method that utilizes the water content of the used oil to enhance the re-refining method.

It is a further objective of some embodiments of this invention to provide a used oil re-refining method for separating metals and organometallic compounds from the used oil and then distilling the oil in the absence of interfering amounts of metals or organometallic compounds. It is in particular a further objective of some embodiments of this invention to provide a used oil re-refining method that includes the elimination of interfering amounts of zinc, zinc compounds, phosphorous, and phosphorous compounds prior to the distillation of the oil.

It is a further objective of some embodiments of this invention to provide a used oil re-refining method that includes the reduction of the oil viscosity prior to its distillation. It is in particular a further objective of some embodiments of this invention to provide a used oil re-refining method for separating additives their degradation products (collectively "polymers") from used oil and subsequently distilling the oil in the absence of interfering amounts of these polymers. More particularly, it is a further objective of some embodiments of this invention to provide a used oil re-refining method for removing interfering amounts of additives such as viscosity index improvers. It is a still further object of some embodiments of this invention to provide a used oil re-refining method to remove degradation products of oil additives, such as viscosity index improvers.

It is a further object of some embodiments of the invention to pretreat used oil with a caustic at low heat (such as less than 200 degrees Fahrenheit), mix the used oil with liquid propane and permit impurities to settle out of the used oil as residuum.

It is a further object of some embodiments of the invention to mix used oil and liquid propane and to then allow the produced residuum to settle out in an extraction vessel.

It is an object of the invention to mix the liquid propane with the used oil using laminar flow, such as that provided by a globe valve or an orbit valve, rather than by turbulent flow such as bubbling.

It is an object of some embodiments of the invention to mix the used oil and the liquid propane prior to introduction of the used oil to a settling vessel where residuum will settle out of the used oil.

It is an object of the invention to provide a method for pretreating and recovering waste oil that includes refining the waste oil only one time, in contrast with many prior art methods that re-refine the waste oil twice.

It is a further objective of some embodiments of this invention to provide a used oil re-refining method that eliminates mechanical agitation to enhance the precipitation of contaminants from the used oil during the liquid extraction step.

It is a further objective of some embodiments of this invention to provide a used oil re-refining method that includes a moderate temperature pretreatment of the oil mixed with alkaline aqueous solution and a phase transfer catalyst.

It is a further objective of some embodiments of this invention to provide a used oil re-refining method that includes an oil pretreatment mixing that does not form emulsions.

It is a further objective of some embodiments of this invention to provide a pretreatment method that enhances the removal of metals, metal compounds, polymers and compounds resulting from polymer breakdown that are contained in the used oil.

It is a further objective of some embodiments of this invention to provide a used oil re-refining method for producing a base oil whose characteristics are similar to those of commercially available base oils.

It is a further objective of some embodiments of this invention to provide a used oil re-refining method that can be implemented with simple and ordinarily available apparatuses.

It is a further objective of some embodiments of this invention to provide a used oil re-refining method that does not rely on complex separation steps or uncommon or expensive reagents.

It is a further objective of some embodiments of this invention to provide a used oil re-refining method that is cost effective and that relies on readily available chemical products. In particular, it is a further objective of some embodiments of this invention to provide a used oil re-refining method that does not rely on contact poisons or substances whose biological activity would make them environmentally undesirable.

These and other objectives of this invention may be achieved in some preferred embodiments by a method comprising the steps of pretreating used oil at moderate temperature with a basic substance and a phase transfer catalyst and in the presence of water; mixing the pretreated oil with liquid propane; removing the impurities from the oil in a liquid-to-liquid extractive system; separating the impurity-free oil from the liquid propane, and re-re-refining the recovered oil. The impurities removed from the oil include metals and metal-containing compounds, phosphorous-containing compounds, polymers, and compounds that result from the break down or decomposition of polymers. In one preferred embodiment, the precipitation of impurities is achieved after the pretreated oil is mixed with the liquid propane. This precipitation is preferably accomplished by avoiding the formation of emulsions that would impede or slow down the precipitation of impurities to the bottom of the liquid-to-liquid extractive system.

Additional objects, features and advantages of this invention will become apparent to persons of ordinary skill in the art upon reading the remainder of the specification and upon referring to the attached FIGURE.

IV. BRIEF DESCRIPTION OF THE DRAWING

FIG. 1 shows a block diagram of the main steps of an embodiment of the invented method and apparatus for treating used oil.

V. DETAILED DESCRIPTION OF THE PREFERRED EMBODIMENTS

The embodiments of the invention illustrated below exemplify the application of the useful characteristics of the invented method and system, and further reference to these and other useful and novel features is made in the following discussion of each illustrative embodiment. None of the embodiments of the invention shown in the accompanying FIGURE or discussed herein is intended to limit the scope of the invention or the constitutive cooperative elements in the invention. Instead, the embodiments discussed in the text and represented in the accompanying FIGURE are merely exemplary illustrations of working embodiments of the invention. Embodiments of the invented used oil recovery method are represented by the block diagram shown in FIG. 1. This and other exemplary embodiments are not intended for delineating limitations of the apparatuses or materials that are needed for performing the invented process.

A. Reference to the FIGURE

Referring to FIG. 1, used oil 101 is mixed with an aqueous basic solution 102 and optionally a phase transfer catalyst 103. This mixing 105A and 105B is preferably performed in two mixing vessels 106A and 106B, and is preferably performed under conditions of mild heat (i.e., under about 200 degrees Fahrenheit). The mixing vessels 106A and 106B are preferably arranged in series so that oil and pretreatment chemicals may be fed into the first mixing vessel 106A, mixing can occur, the partially mixed oil and pretreatment chemicals may move to the second mixing vessel 106B, further mixing may occur, and then pretreated used oil 107 which is fully mixed but not over-mixed (so as to form an emulsion) is the result. As depicted in the FIGURE, the mixing vessel or vessels may be arranged to perform a continuous process, or if preferred by the user, a batch processing environment may be established. The mixing employed is a nonvigorous action that causes the oil and any pretreatment chemicals and water to come into contact with each other. The mixing can be performed by use of a propellor, by agitation, or by any other means that contacts the components to be mixed.

A significant difference between the invented method and system and other recycling processes is the presence of water in the used oil 101. In conventional recycling processes, water in the used oil must be removed prior to treatment. For example, if prior art cracking methods are used which operate at about 650 degrees Fahrenheit, the presence of water in the oil would be undesirable because it would form steam and could be explosive. The implementation of a dehydration step makes these prior art recycling processes more complicated and more expensive. Also, the high temperature used by prior art recycling would be incompatible with the invented method and the use of water, because high temperature would eliminate the aqueous phase unless drastic conditions and great expense were acceptable. High temperature prior art processes are also incompatible with the invention because high temperatures would decompose the phase transfer catalyst. In contrast, the invention turns the presence of water in the oil to an advantage, because the presence of water in the used oil 101 yields two phases, an aqueous phase and an organic phase in the pretreated used oil 107, helping to remove contaminants from the oil.

In some preferred embodiments of the invention, the optimal amount of water present is in the range of about 5 to 10 percent by volume. Used oil of greater or lesser water content is suitable for use with the invented method and system by adjusting the water content appropriately. When the used oil 101 contains at least about 5% by volume water the total amount of chemicals used for oil pretreatment depends on the total amount of metals present in the used oil and may vary from 0.4% to 2.0% by weight of the used oil. The amount of phase transfer catalyst may vary from 0.01 to 0.1% by weight of the used oil. The following is an example of component ratios for used oil pretreatment: about 30320 liters (about 8000 gallons) of used oil 101 is mixed with about 3.8 liters (about 1 gallon) of phase transfer catalyst 103 and about 324 kilograms (about 720 pounds) of aqueous basic solution 102. One example of an aqueous basic solution is a 45% solution of potassium hydroxide. The basic solution may by substituted by an anhydrous base, such as about 146 kilograms (about 325 pounds) of anhydrous potassium hydroxide. The components to be employed for pretreatment of used oil should be added together and mixed appropriately for the quantities involved and the method used (whether continuous or batch).

When the used oil contains less than about 5% by volume of water, an amount of water should be added to the used oil either before the used oil reaches the pretreatment vessels 106A and 106B or in the pretreatment vessels. The preferred amount of water to be added is approximated by the following equation:

$$(5-x)\times 303=y,$$

where x is the percentage of water in the used oil and y is the volume of water in liters to be added to pretreatment vessel 106A. The corresponding amount of water in gallons is obtained by replacing the constant 303 with the constant 80.

As mixing or pretreatment is performed, the used oil is preferably heated to not more than about 180 degrees Fahrenheit and preferably only 170 degrees Fahrenheit for about 30 to 90 minutes during mixing, with adequate mixing having been found after 30 or 60 minutes. The pretreatment temperature is maintained below the boiling point of water to avoid loss of water.

The pretreated used oil 107 is then cooled 108 to about 90 to 110 degrees Fahrenheit.

Impurities in used oil 101 react in the pretreatment vessels 106A and 106B with base 102. A phase transfer catalyst 103 and heat 104 may be used to accelerate the reaction. The phase transfer catalyst 103 is intended to assist transfer of base from the aqueous to the organic phase.

Phase transfer catalyst 103 is most preferably a quaternary ammonium salt that is inexpensive, readily available, has high organic phase as well as aqueous phase solubility, presents little or no risk of aqueous waste stream contamination, and is highly reactive in phase transfer catalysis-OH reactions. A preferred phase transfer catalyst is tricaprylyl methyl ammonium chloride, marketed by Henkel under the tradename ALIQUAT 336. This phase transfer catalyst is not recovered in the preferred method because it is inexpensive, is used in small amounts, and is not detrimental to the quality of the recycled oil. Those of ordinary skill in the art will be able to determine other acceptable phase transfer catalysts.

The basic solution 102 can be any appropriate basic solution that will assist in the precipitation of impurities from used oil. In some embodiments of the invention, a mixture of two bases are used to pretreat used oil 101. The table below shows preferred bases.

TABLE I

PREFERRED BASES FOR PRETREATMENT METHOD

| FIRST BASE Hydroxides & hydrides | SECOND BASE phosphates & carbonates |
|---|---|
| Ammonium hydroxide $NH_4OH$ | Ammonium phosphate tribasic $(NH_4)_2PO_4$ |
| Lithium hydroxide LiOH | Ammonium phosphate monobasic $(NH_4)H_2PO_4$ |
| Lithium hydride LiH | Ammonium carbonate $(NH_4)_2CO_3$ |
| Potassium hydroxide KOH | Cesium carbonate $CS_2CO_3$ |
| Potassium ethoxide $KOC_2H_5$ | Diammonium phosphate (DAP) $(NH_4)_2HPO_4$ |
| Potassium hydride KH | Lithium carbonate $Li_2CO_3$ |
| Potassium t-butoxide $(CH_3)_3COK$ | Potassium phosphate tribasic $K_3PO_4$ |

TABLE I-continued

PREFERRED BASES FOR PRETREATMENT METHOD

| FIRST BASE Hydroxides & hydrides | SECOND BASE phosphates & carbonates |
|---|---|
| Potassium methoxide $K(OCH_3)$ | Potassium phosphate dibasic $K_2HPO_4$ Potassium carbonate $K_2CO_3$ |
| Sodium hydroxide NaOH | Potassium phosphate monobasic $KH_2PO_4$ |
| Sodium ethoxide $NaOC_2H_5$ | Sodium carbonate $Na_2CO_3$ |
| Sodium hydride NaH | Sodium phosphate tribasic $Na_3PO_4$ |
| Sodium t-butoxide $(CH_3)_3CONa$ | Sodium phosphate monobasic $NaH_2PO_4$ |
| Sodium methoxide $Na(OCH_3)$ | Sodium phosphate dibasic $Na_2HPO_4$ |

Bases other than those shown may also be used, or a single base or more than two bases can be used. It is preferred to use both a first base and a second base in pretreating used oil in order to maximize precipitation of impurities from the oil. The process steps described above are referred to herein as "pretreatment".

Referring to FIG. 1 again, after cooling 108 the pretreated used oil 107 to an appropriate temperature, the used oil is mixed with liquid propane 109 with an appropriate mixing device 110. Note that as depicted and as preferred, the mixing of used oil and propane takes place prior to introduction of the used oil into an extraction vessel or a settling vessel. The mixing device 110 will preferably provide laminar rather than turbulent mixing of the used oil with liquid propane. A globe valve or an orbit valve as are commonly available from valve makers is preferred. Other mixing such as agitation or use of a venturi may also be used in the invention.

Although liquid propane 109 is the preferred solvent of the inventors, other solvent hydrocarbons such as a $C_3$–$C_5$ saturated hydrocarbon or a mixture of several solvents may be used. Preferably, pretreated used oil 107 and the solvent such as liquid propane 109 are mixed in a ratio of about 5:1 to about 7:1. In other embodiments, other ratios could be used, such as 3:1 to 10:1.

After propane 109 and pretreated used oil 107 are mixed, the mixture of used oil and propane is introduced into an extraction vessel 111A. The impurities in the oil/propane mixture tend to precipitate toward the bottom of the extraction vessel 111A. Those impurities are removed from the bottom of the extraction vessel as residuum. The remainder of the oil/propane mixture is removed from the side or top of the extraction vessel 111A at a point preferably near or at the top of the vessel and always above the bottom of the vessel.

In order to achieve effective separation of impurities from the used oil, the extraction vessel does not contain interfering emulsions and turbulence and fluid flow pertubations are avoided. Flocculants form and drop to the bottom of the extraction vessel, to be removed from The bottom as residuum. No gas is injected into the extraction vessel 111A. Gas bubbles are a detriment to good contact between the solvent and the pretreated oil. Gas bubbles will interfere with flocculant formation and will prevent precipitation of residuum.

As liquid-to-liquid extraction of impurities proceeds in the extraction vessel 111A and the settling vessel 111B, a light fraction 112 including oil and liquid propane is extracted from the side or the top of the extraction vessel 111A and the settling vessel 111B. Heavy fraction 113 is extracted from the bottom of the extraction vessel 111A and the settling vessel 111B. Heavy fraction 113 contains asphaltic material, water and a high percentage of the metals and phosphorous compounds, polymers and other impurities that were present in the used oil 101. After the liquid propane and water have been removed by stripping 114, the heavy fraction 113 becomes asphalt residuum 115 or asphalt extender. After stripping 114, condensation 122 and separation 123 steps may be performed to yield liquid hydrocarbons and water. From the separation step 123, some gaseous propane 117 may be recovered for re-used in the system.

The settling vessel 111B is a second extraction vessel through which the mixture of used oil and propane moves slowly so that additional residuum may precipitate to the bottom of the vessel and be removed. The result of using an extraction vessel and a settling vessel is maximization of the amount of impurities that can be removed from the used oil, thus presenting a very clean used oil for re-refining.

The use of extraction vessel 111A and the settling vessel 111B in the invention permits the continuous extraction of impurities and continuous production of light fraction 112. The liquid propane is then removed from light fraction 112 by stripping 116 that yields regenerated oil 119 and gaseous propane 117. Depending on the hydrocarbon composition of regenerated oil 119, it can be used directly as base oil 120 or it can be distilled 121 to separate regenerated oil 119 into different fractions of light oil and base oil 120. Condensation 118 of gaseous propane 117 yields liquid propane 109 that can be recycled for mixing in the invented process with the pretreated used oil 107 after its cooling 108. Whereas the liquid propane that is mixed with pretreated used oil 107 is preferably liquid propane that has previously been used in the invented process, liquid propane 109 may also be fresh or a combination thereof.

The separation and removal of interfering impurities in separation vessels 111A and 111B leads to light fraction 112 that is essentially free of compounds that would cause the fouling of rerefining equipment. This specifically includes regenerated oil 119 and distillation 121.

The steps represented by solid arrows in FIG. 1 represent a preferred embodiment of the invention. Another embodiment of the invention is represented by dashed arrows. In this embodiment, liquid propane 109 is also injected near the bottom of the extraction vessel 111A to generate a counercurent flow to that of the precipitants in the vessel. The liquid propane countercurrent flow is opposite to the settling direction of the precipitant impurities. The countercurrent flow should be established to avoid turbulence, flow perturbations and bubbling. In this embodiment of the invention, the volumetric ratio of oil to liquid propane is preferably maintained at about 1:5, where one part liquid propane is contributed by the countercurrent flow.

It is important to emphasize that the used oil 101 is chemically pretreated by mixing it with pretreatment chemicals under heat, mixing it with propane, and settling out impurities in extraction and settling vessels. These steps are all performed at low temperatures, such as lower than 200 degrees Fahrenheit, and without performing any hydrocarbon cracking. Thus, with the invented method and system, used oil can be recycled into finished product with only one refining step (refining performed on the regenerated oil) rather than two refining steps as in some prior art methods. It is also significant that with the invention, the waste oil and propane are mixed prior to introduction of waste oil into a settling or extraction vessel. This allows thorough mixing (but not excessive mixing) of waste oil and propane without causing disruptive currents in the extraction or settling vessel which would disrupt settling out of impurities. The mixing performed is laminar mixing rather than turbulent mixing. Also, when the invention is implemented, there must be some water present in the mixture of used oil and propane in order to encourage flocculant formation and settling out of impurities. This is in contrast to prior art where the presence of water is undesirable. The invented method and system also preferably uses two mixing vessels for pretreatment of used oil with chemicals such as a basic solution and a phase transfer catalyst. Also, preferably an extraction vessel and a settling vessel are used in order to cause impurities to settle out of the used oil/propane mixture to the greatest extent possible. And it is also important that in the extraction and settling vessels, heavy fraction or impurities are removed from a location at the bottom of the vessel, while light fraction is removed from the vessel at a location higher than the location for removal of heavy fraction, such as the side or top of the vessel.

B. Experimental Data

Because zinc and its compounds are the major cause of fouling when they are not effectively removed from the oil, the reduction in the amount of zinc by different methods indicates the relative abilities for effectively regenerating oil while avoiding equipment fouling. The percentage by weight of zinc removed by methods that rely on bubbling of a gas through the medium that contains the oil and liquid propane is only about 20% by weight. This percentage can be as low as 15% by weight due to poor mixing of the oil and liquid propane. The invented method achieves thorough mixing, without emulsion formation, by means of mixing device 110 which mixes liquid propane with used oil through substantially laminar flow rather than through turbulent mixing. The preferred mixing device 110 is a globe valve or orbit valve. It is also important that the mixing of used oil and liquid propane in the invention takes place separate from the extraction vessel 111B and settling vessel 111B, in contrast with prior art where the mixing of used oil and propane took place with turbulent flow in an extraction vessel. Tests show that thorough mixing with mixing device 110, without emulsion formation, yields about 55% zinc reduction. Methods that lead to the formation of emulsions reduce the zinc content to a somewhat greater extent than sparging or bubbling alone, but the amount of zinc remaining in the oil is large enough to cause fouling in some downstream re-refining equipment. For example, in a test in which emulsions were formed with a venturi device, only about 42% by weight of zinc was removed from the used oil. In contrast, by combining thorough mixing without emulsion formation and the invented pretreatment, the invented method removes about 85% by weight of zinc from the used oil.

Tables 2 & 3 show test results that compare the abilities of different methods to remove impurities from used oil. All the results are concentrations in parts per million (ppm). The first column in each table lists the impurities whose presence has been tested in used oil.

TABLE 2

IMPURITY REMOVAL VIA THREE DIFFERENT METHODS OF MIXING USED OIL WITH PROPANE

| Impurities (ppm) | Bubbling propane through used oil | Bubbling propane through regenerated oil | Venturi mixing of propane with used oil | Venturi mixing of propane with regenerated oil | Globe valve mixing of propane with used oil | Globe valve mixing of propane with regenerated oil |
|---|---|---|---|---|---|---|
| Iron | 86 | 36 | 87 | 24 | 79 | 8 |
| Chromium | 0 | 0 | 0 | 0 | 0 | 0 |
| Lead | 52 | 50 | 29 | 18 | 22 | 16 |
| Copper | 50 | 67 | 49 | 77 | 47 | 71 |
| Tin | 3 | 3 | 6 | 0 | 3 | 0 |
| Aluminum | 11 | 3 | 14 | 0 | 10 | 0 |
| Nickel | 0 | 0 | 0 | 0 | 0 | 0 |
| Silver | 0 | 0 | 0 | 0 | 0 | 0 |
| Maganese | 0 | 0 | 0 | 0 | 0 | 0 |
| Silicon | 27 | 15 | 64 | 25 | 110 | 99 |
| Boron | 63 | 23 | 44 | 8 | 51 | 1 |
| Sodium | 81 | 27 | 424 | 117 | 90 | 31 |
| Magnesium | 542 | 197 | 350 | 154 | 407 | 15 |
| Calcium | 1458 | 1143 | 1054 | 455 | 896 | 145 |
| Barium | 1 | 1 | 17 | 3 | 15 | 1 |
| Phosphorous | 613 | 582 | 636 | 525 | 1047 | 515 |
| Zinc | 640 | 613 | 627 | 586 | 969 | 435 |
| Molybdenum | 1 | 0 | 8 | 3 | 0 | 0 |
| Titanium | 2 | 0 | 0 | 0 | 0 | 0 |
| Vanadium | 0 | 0 | 0 | 0 | 0 | 0 |
| Cadmium | 0 | 0 | 0 | 0 | 0 | 0 |
| Lithium | 0 | 0 | 11 | 5 | 0 | 0 |
| Arsenic | 0 | 0 | 29 | 42 | 0 | 0 |
| Total ppm | 3630 | 2760 | 3449 | 2042 | 3746 | 1336 |
| % reduction | | 24% | | 41% | | 64% |

Table 2 shows a comparison of three different methods of mixing propane with non-chemically pretreated used oil. Bubbling propane with used oil, mixing propane with used oil by use of a venturi, and mixing propane with used oil by use of a globe valve are compared. The second, fourth and sixth columns of Table 1 show the concentration of impurities in the used oil samples. The third column shows the concentration of impurities after extraction during which used oil was mixed with propane by bubbling the propane through the oil. The fifth column shows concentrations of impurities in oil after mixing used oil with propane by use of a venturi. The seventh column shows the concentration of impurities in oil after mixing the used oil with propane with a globe valve. No chemical pretreatment was applied to the used oil. The results show that use of a globe valve to mix the used oil and propane is much more effective in removing impurities from the oil than the other methods.

TABLE 3

IMPURITY REMOVAL BY MIXING OF CHEMICALLY PRETREATED OIL AND PROPANE VIA VENTURI AND GLOBE VALVE

| | Chemical pre-treatment with venturi | | | Invented method - chemical pre-treatment using globe valve | | |
|---|---|---|---|---|---|---|
| Impurities | Used oil | Re-Generated oil | Impurity reduction (% by weight) | Used Oil | Re-Generated Oil | Impurity reduction (% by weight) |
| Iron | 69 | 2 | | 70 | 5 | |
| Chromium | 0 | 0 | | 0 | 0 | |
| Lead | 315 | 232 | 26% | 331 | 159 | 52% |
| Copper | 15 | 13 | | 9 | 9 | |
| Tin | 0 | 0 | | 3 | 0 | |
| Aluminum | 10 | 1 | | 7 | 0 | |
| Nickel | 0 | 0 | | 0 | 0 | |
| Silver | 0 | 0 | | 0 | 0 | |
| Manganese | 0 | 0 | | 0 | 0 | |
| Silicon | 18 | 10 | | 16 | 50 | |
| Boron | 11 | 0 | | 93 | 0 | |
| Sodium | 82 | 21 | 74% | 96 | 12 | 88% |
| Magnesium | 294 | 10 | 97% | 310 | 6 | 98% |

TABLE 3-continued

IMPURITY REMOVAL BY MIXING OF CHEMICALLY PRETREATED OIL AND PROPANE VIA VENTURI AND GLOBE VALVE

| | Chemical pre-treatment with venturi | | | Invented method - chemical pre-treatment using globe valve | | |
|---|---|---|---|---|---|---|
| Impurities | Used oil | Re-Generated oil | Impurity reduction (% by weight) | Used Oil | Re-Generated Oil | Impurity reduction (% by weight) |
| Calcium | 2394 | 820 | 66% | 2567 | 309 | 88% |
| Barium | 2 | 0 | | 2 | 0 | |
| Phosphorus | 587 | 335 | 43% | 804 | 221 | 73% |
| Zinc | 868 | 251 | 71% | 889 | 135 | 85% |
| Molybdenum | 3 | 0 | | 0 | 0 | |
| Titanium | 0 | 0 | | 0 | 0 | |
| Vanadium | 0 | 0 | | 0 | 0 | |
| Cadmium | 0 | 0 | | 0 | 0 | |
| Lithium | 0 | 0 | | 0 | 0 | |
| Arsenic | 0 | 0 | | 0 | 0 | |
| Total/ppm | 4668 | 1695 | 64% | 5197 | 906 | 83% |

Referring to Table 3, the benefits of substantially minimizing turbulence or interfering flow perturbations during the liquid-liquid extraction are shown. The second and third columns show impurity concentrations in used oil and in regenerated oil that was obtained after the used oil was subject to the invented pre-treatment followed by mixing with liquid propane followed by injection of the liquid propane/oil mixture into the extraction vessel by means of a Venturi device. The fifth and sixth columns show impurity concentrations in used oil and in regenerated oil that were obtained by the invented method. Columns four and seven highlight impurity reductions, given as percentages by weight, for some impurities. The invented method provides substantial reductions over the venturi method in the residual amounts of lead, sodium, phosphorous and zinc. Table 3 shows that when used oil is chemically pretreated prior to being mixed with propane, mixing with a globe valve continues to be far more effective for later removal of impurities than mixing with a venturi.

The presence of a phase transfer catalyst (PTC) in the chemical pretreatment process allows the reaction to take place at 170 degrees Fahrenheit instead of 200 degrees Fahrenheit. The lower temperature is very important not only from the economic view, but also due to cooling required following the pretreatment since the liquid-to-liquid extraction must be performed at a temperature of 110 degrees Fahrenheit or less. The presence of PTC also reduces the amount of impurities in the pretreated oil by 15% compared to pretreatment only using a base (potassium hydroxide) as the reactant.

The invented method also provides substantial reduction in the viscosity of the re-refined base oil as compared with the used oil. For example, used oil with a viscosity of 56.02 centistokes at 40° C. was reduced to 22.91 centistokes in re-refined base oil. At 100° C., the viscosity was reduced from 8.65 to 4.91 centistokes.

By comparing the viscosity of newly blended oil, the effectiveness of the invented method in removing viscosity index improvers can be observed. Table 4 compares the viscosities of new oil with additives, without additives and with additives but after treatment with the invented method.

TABLE 4

VISCOSITY AND VISCOSITY INDEX OF BASE OIL, BASE OIL WITH ADDITIVES AND BASE OIL WITH ADDITIVES TREATED VIA INVENTED METHOD

| | Viscosity (centistokes) | | |
|---|---|---|---|
| | 40° C. | 100° C. | Viscosity Index |
| Formulated 10W-40 oil | 107.67 | 16.87 | 182 |
| Blended base without Additives (will increase when additives are added) | 27.4 | 4.75 | 108 |
| Formulated 10W-40 oil treated with the invented method | 32.86 | 5.97 | 133.5 |

Table 4 shows that at 100° C., unblended base oil has a viscosity of 4.75 centistokes. After the addition of viscosity index improvers, the viscosity increases to 16.87 centistokes. After treatment with the invented method, treated oil has a viscosity of 5.97 centistokes, or about 90% of its original viscosity.

The features of the invention as depicted and discussed above can be suitably combined, modified and added to generate additional embodiments of the present invention. These additional combinations however, can be performed with the aid of the objectives and teachings herein contained and ordinary skills in the art. In addition, the exemplary embodiments herein illustrated are merely representative of the invented device, which comprises embodiments with features equivalent to those herein characterized for accomplishing the objectives of this invention.

What is claimed is:

1. A pretreatment method for removing impurities from used oil, the pretreatment method comprising:

(a) introducing a basic substance to used oil to produce a premix, said premix having some water contained therein, said basic solution including a first base selected from the group consisting of potassium hydroxide, sodium hydroxide, ammonium hydroxide, lithium hydroxide, potassium ethoxide, sodium ethoxide, potassium hydride, sodium hydride, lithium hydride, potassium t-butoxide, sodium t-butoxide, potassium methoxide, and sodium methoxide, and said basic solution including a second base from the group consisting of diammonium phosphate, ammonium phosphate tribasic, ammonium phosphate monobasic, sodium phosphate tribasic, sodium phosphate monobasic, sodium phosphate dibasic, potassium phosphate tribasic, potassium phosphate dibasic, potassium phosphate monobasic, sodium carbonate, potassium carbonate, ammonium carbonate, lithium carbonate, cesium carbonate, (a) heating said premix to a temperature of not more than about 180 degrees Fahrenheit, (b) placing said premix into a first pretreatment vessel, (c) mixing said premix in said first pretreatment vessel, (d) moving said premix from said first pretreatment vessel to a second pretreatment vessel, (e) mixing said premix in said second pretreatment vessel to obtain a pretreated used oil, (f) cooling said pretreated used oil to a temperature between 90 degrees and 110 degrees Fahrenheit, (g) mixing said cooled pretreated used oil with liquid propane by use of a mixing device that provides substantially laminar flow of said used oil and said liquid propane in order to contact said propane with said used oil, (h) introducing said mixture of used oil and liquid propane into an extraction vessel, (i) permitting impurities to flocculate and settle out of said mixture of used oil and liquid propane in said extraction vessel, said impurities settling toward the bottom of said extraction vessel, (j) removing impurities from said extraction vessel from a location near the bottom of said extraction vessel, (k) moving said used oil and liquid propane to a settling vessel, (l) permitting impurities to settle out of said used oil and liquid propane mixture in said settling vessel, (m) removing light fraction containing said used oil mixed with propane from said settling vessel.

2. A method as recited in claim 1 further comprising introducing a phase transfer catalyst into said premix, wherein said phase transfer catalyst facilitates the reaction of organometallic compounds in said used oil with said basic solution to convert metal impurities in said used oil into metal salts and thus to facilitate removal of impurities from said used oil.

3. A method as recited in claim 2, wherein said phase transfer catalyst is a quaternary ammonium salt.

4. A method as recited in claim 2, wherein said phase transfer catalyst is tricaprylyl methyl ammonium chloride.

5. A method as recited in claim 1, wherein said mixing of oil and a base in pretreatment vessels is performed in a time not exceeding about 90 minutes.

6. A method a recited in claim 1, wherein, if said used oil has a water content of less than 5% by volume, the water content of the used oil is adjusted to at least 5% by volume.

7. A method as recited in claim 1 wherein said used oil and liquid propane are mixed in a ratio of about 5:1 to 7:1.

8. A method as recited in claim 1 wherein said mixing of liquid propane and oil is performed using a globe valve.

9. A pretreatment method for removing impurities from used oil, the pretreatment method comprising:

(a) introducing a basic substance to used oil to produce a premix, said premix having some water therein;

(b) heating said premix to a temperature below the normal boiling temperature of water;

(c) moderately stirring said premix to obtain a pretreated used oil;

(d) cooling said pretreated used oil, (e) mixing said pretreated used oil with liquid propane by use of substantially laminar flow of said used oil and said liquid propane, (f) introducing said mixture of used oil and liquid propane into an extraction vessel, (g) permitting impurities to settle out of said mixture of used oil and liquid propane in said extraction vessel, (h) removing impurities from said extraction vessel from a location near the bottom of said extraction vessel, (i) removing light fraction from said extraction vessel from a location on said extraction vessel higher than the location where impurities are removed.

10. A method as recited in claim 9 further comprising introducing a phase transfer catalyst into said premix, wherein said phase transfer catalyst facilitates the hydrolysis of impurities in said used oil.

11. A method as recited in claim 9 wherein said basic substance is selected from the group consisting of diammonium phosphate, ammonium phosphate tribasic, ammonium phosphate monobasic, sodium phosphate tribasic, sodium phosphate monobasic, sodium phosphate dibasic, potassium phosphate tribasic, potassium phosphate dibasic, potassium phosphate monobasic, sodium carbonate, potassium carbonate, ammonium carbonate, lithium carbonate, cesium carbonate, potassium hydroxide, sodium hydroxide, ammonium hydroxide, lithium hydroxide, potassium ethoxide, sodium ethoxide, potassium hydride, sodium hydride, lithium hydride, potassium t-butoxide, sodium t-butoxide, potassium methoxide, and sodium methoxide and combinations of these.

12. A method as recited in claim 9, wherein said basic substance is a 45% aqueous solution of potassium hydroxide.

13. A method as recited in claim 9, further comprising the steps of:

(j) stripping propane from said light fraction to create regenerated oil, and (k) distilling said regenerated oil to create base oil.

14. A pretreatment method for removing impurities from used oil, the pretreatment method comprising:

(a) obtaining a quantity of used oil having a water content of at least about 5% by volume, (b) obtaining a basic solution, (c) placing said used oil and basic solution into a pretreatment vessel, (d) mixing said basic solution and said used oil in said pretreatment vessel for about 30 to 90 minutes while exposing them to heat not greater than the boiling point of water in order to create pretreated used oil, (e) mixing said pretreated used oil with liquid propane by use of a mixing device that is not interior to an extraction vessel and is not interior to a settling vessel, (f) introducing said mixture of used oil and liquid propane into an extraction vessel, (g) permitting impurities to flocculate and settle out of said mixture of used oil and liquid propane in said extraction vessel, said impurities settling toward the bottom of said extraction vessel to create a heavy fraction, (h) removing heavy fraction from said extraction vessel from a location near the bottom of said extraction vessel, (i) removing used oil and liquid propane from said extraction vessel from a location on said extraction vessel that is higher than the location where heavy fraction is removed, (j) moving said mixed used oil and liquid propane to a settling vessel, (k) permitting impurities to settle out of said mixed used oil and liquid propane mixture in said settling vessel, (l) removing heavy fraction from said settling vessel, (n) removing light fraction from said settling vessel.

15. A method as recited in claim 14 further comprising re-refining said light fraction to create base oil.

16. A method as recited in claim 14 wherein said basic solution comprising at least one base from the group consisting of potassium hydroxide, sodium hydroxide, ammonium hydroxide, lithium hydroxide, potassium hydroxide, sodium ethoxide, potassium hydride, sodium hydride, lithium hydride, potassium t-butoxide, sodium t-butoxide, potassium methoxide, sodium methoxide, diammonium phosphate, ammonium phosphate tribasic, ammonium phosphate monobasic, sodium phosphate tribasic, sodium phosphate monobasic, sodium phosphate dibasic, potassium phosphate tribasic, potassium phosphate dibasic, potassium phosphate monobasic, sodium carbonate, potassium carbonate, ammonium carbonate, lithium carbonate, and cesium carbonate.

17. A method as recited in claim 14 wherein said basic solution comprises a first base and a second base.

18. A method as recited in claim 17 wherein said first base is selected from the group consisting of potassium hydroxide, sodium hydroxide, ammonium hydroxide, lithium hydroxide, potassium hydroxide, sodium ethoxide, potassium hydride, sodium hydride, lithium hydride, potassium t-butoxide, sodium t-butoxide, potassium methoxide, and sodium methoxide.

19. A method as recited in claim 18 wherein said second base is selected from the group consisting of diammonium phosphate, ammonium phosphate tribasic, ammonium phosphate monobasic, sodium phosphate tribasic, sodium phosphate monobasic, sodium phosphate dibasic, potassium phosphate tribasic, potassium phosphate dibasic, potassium phosphate monobasic, sodium carbonate, potassium carbonate, ammonium carbonate, lithium carbonate, and cesium carbonate.

20. A method as recited in claim 14 wherein said mixing device is a globe valve.

* * * * *